United States Patent [19]

Newcomb et al.

[11] 3,958,754

[45] May 25, 1976

[54] SNOW LOAD REMOVAL

[75] Inventors: Morton Austin Newcomb; Johan A. Bjorksten, both of Madison, Wis.

[73] Assignee: Griffolyn Company, Inc., Houston, Tex.

[22] Filed: Nov. 15, 1974

[21] Appl. No.: 523,974

Related U.S. Application Data

[60] Division of Ser. No. 388,090, Aug. 14, 1973, Pat. No. 3,908,901, which is a continuation-in-part of Ser. No. 113,904, Feb. 9, 1971, abandoned.

[52] U.S. Cl. ..... 237/1 R; 237/52; 52/2; 165/32; 428/315

[51] Int. Cl.[2] ..... F24D 3/02

[58] Field of Search ..... 237/1 R, 81, 52, 1; 52/2, 81; 165/32; 161/141, 152, 160, 205, 151; 264/45

[56] References Cited

UNITED STATES PATENTS

| | | | |
|---|---|---|---|
| 2,649,101 | 8/1953 | Suits | 52/2 |
| 2,690,185 | 9/1954 | Pomykala | 52/81 |
| 3,183,996 | 5/1965 | Capaul | 161/141 |
| 3,187,069 | 6/1965 | Pincus et al. | 264/45 |
| 3,257,266 | 6/1966 | Sapper | 161/205 |
| 3,265,236 | 8/1966 | Gibbon et al. | 161/152 |
| 3,304,665 | 2/1967 | Lee | 52/2 |
| 3,563,845 | 2/1971 | Stevens | 161/140 |

*Primary Examiner*—Kenneth W. Sprague
*Assistant Examiner*—James C. Yeung
*Attorney, Agent, or Firm*—John M. Diehl; Johan A. Bjorksten

[57] ABSTRACT

Means to remove snow loads from a roof includes a roof structure for a building and treating means within the building. The roof structure is characterized by flexibility and relatively high initial thermal insulation value and comprises a relatively non-yielding roof base, an elastically compressible insulating layer resting thereon, and a very light weight continuous top layer positioned outermost, so that the weight of this top layer will be considerably less than the expectable weight of a heavy snowfall. Snow on the roof compresses the insulation and reduces the thermal insulating value so snow on such roof will rapidly be melted by heat leakage through the roof, yet the previous high thermal insulation will be restored as soon as snow pressure ceases.

1 Claim, 5 Drawing Figures

SNOW LOAD REMOVAL

CROSS-REFERENCES

This is a division of application Ser. No. 388,090, filed Aug. 14, 1973, now U.S. Pat. No. 3,908,901, which is a continuation-in-part application of application Ser. No. 113,904, filed Feb. 9, 1971 now abandoned, entitled "Roof Structure and Material".

A base structure to which the invention may be applied is disclosed in co-pending application Ser. No. 361,814, filed May 18, 1973 now abandoned, entitled "Transportable Collapsible Permanent Type Dwellings" which is a continuation-in-part application of application Ser. No. 148,439, filed June 1, 1971 now abandoned, entitled "Transportable Collapsible Permanent Type Dwelling".

FIELD OF THE INVENTION

This invention relates to a method of removing snow loads from buildings to means for removing snow loads which comprises a defined roof structure.

OBJECTS OF THE INVENTION

An object of the invention is an improved self-desnowing roof.

Further objects will become apparent as the following detailed description proceeds.

BRIEF STATEMENT OF THE INVENTION

An elastic insulating material in which the insulating property depends on the thickness of a fluid layer, such as air, is used in a sandwich construction. The lower layer in this sandwich is either in itself unyielding, or rests on a backing which is relatively non-yielding whereby we mean substantially less yielding to pressure than is the outer skin of the roof sandwich, or is tensed so as to be substantially resistant to pressure. The outer layer is substantially weightless, or at least its weight is lower than that of the maximum expectable snowload in the locality where it is used, so that the insulating layer will be compressed to a thinner layer when a surface load is applied. In this construction the thermal conductivity is roughly proportional to the thickness of the insulating layer, and compression substantially and reversibility or elastically reduces the thickness of the insulating layer. Thus, the thermal conductivity of a roof constructed of this material or in this manner will become a fair to good thermal conductor when exposed to a snow load, and will revert to its normal high insulating properties upon cessation of the snow pressure.

DRAWINGS

In the drawings like reference numerals refer to like parts and:

DETAILED DESCRIPTION

Figure 1:
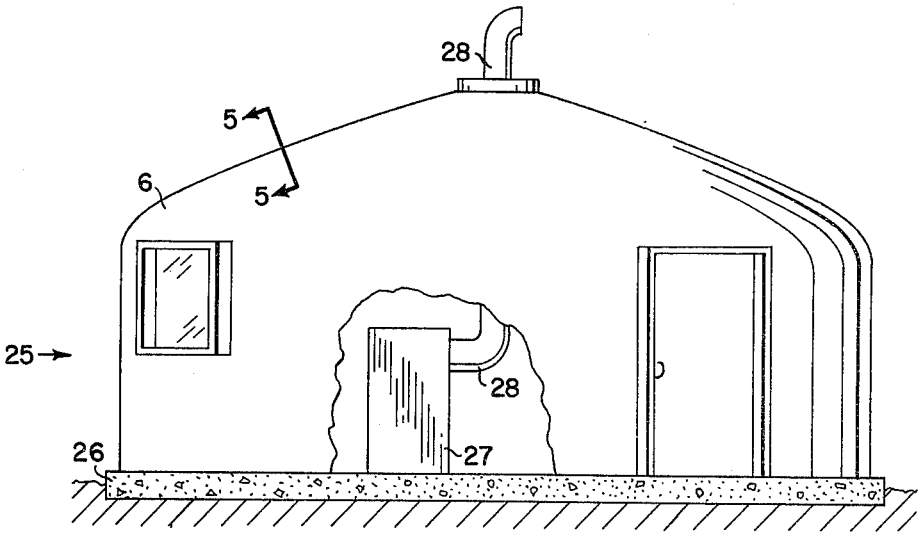
FIG. 1 is a partially cutaway perspective view.
Figure 5:
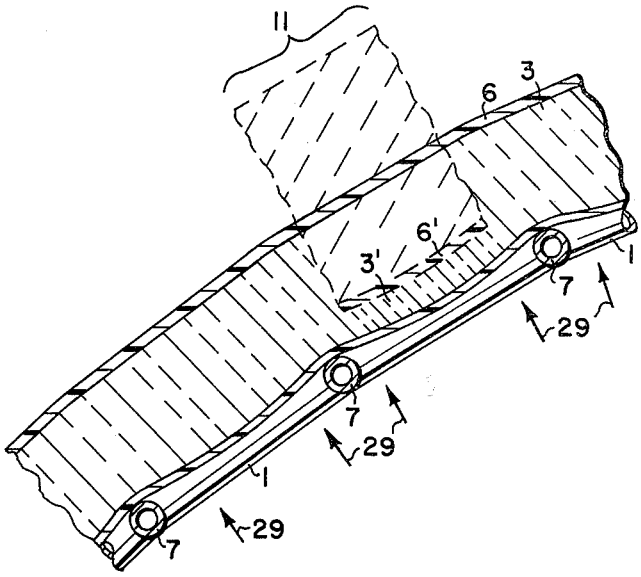
FIG. 5 is an enlarged fragmentary cross-sectional view taken on lines 5—5 in FIG. 1.

Referring to FIGS. 1 and 5, in building 25 on concrete foundation 26, a base layer of self-extinguishing reinforced plastic film 2 is stretched over a steel cage consisting of vertical and horizontal frame members such as tubes 1 and 7 respectively, so as to exert a substantial resistance to surface pressure. Tubes 1 and 7 provide substantially relatively rigid means to support layer 2 in relatively substantially fixed position from other portions of the building. Over film 2 is placed an insulating layer of flexible elastically deformable compressible distensible material such as an 11-inch nominal thickness resilient glass mat., 3, and finally over this a flexible foldable layer 6 consisting substantially of weather resistant polypropylene film, three-film ply, reinforced by two layers of high strength fiber such as steel, glass, polyester, polyurethane or nylon fiber, or their mechanical equivalent. This outer film 6 may be pigmented with an ultraviolet absorbent pigment such as zinc oxide or carbon black, and covered by a coating of a flaky reflectant or UV absorbent material such as aluminum, mica or glass, suspended in a weather resistant binder, such as an acrylate or methacrylate polymer of consistency suitable for such a coating application.

A three-ply fiber reinforced polyethylene film known as "Griffolyn 5" made by Griffolyn Co., Inc., was used as that outer skin of the roof.

The weight of this film was 0.72 ounces/ft.$^2$. We could also use a two-ply reinforced polyethylene film known as "Griffolyn 55", weight 0.385 ounces/ft.$^2$ or a quadruple layer of similar film weight 1.01 ounces/ft.$^2$. Unreinforced film could also be used, so long as it is flexible, foldable, and capable of holding a stationary pressure of at least 20 lbs./ft.$^2$. Inclusion of sound proofing dense granules or ribbons could further increase the weight of the film, however, it should remain sufficiently light not to cause by its own weight a compression of more than 25% of the roof thickness and preferably not more than 10%.

Building 25 is provided with furnace or other heating means 27 which may have smoke pipe 28, which may heat the air in the interior of the building to a temperature higher than the melting temperature of snow and heat therefrom as indicated by arrows 29 may enter the roof structure through layer 2. It may then pass through layers 3 and 6 to heat snow which is superposed on layer 6. The presence of such snow 10 is indicated for a limited portion of the structure of FIG. 5 at 11 in dashed lines wherein the positions of layers 3 and 6 under such a snow load are indicated at 3′ and 6′.

Figure 3:
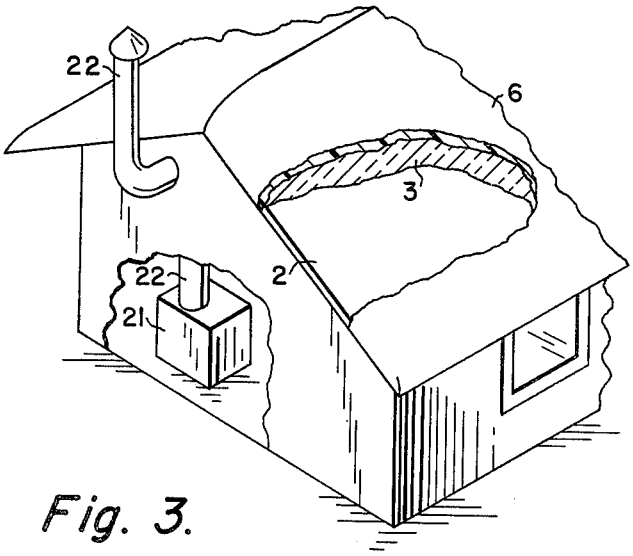
FIG. 3 is an enlarged fragmentary cross-sectional view of a portion of the roof structure of FIG. 2.
Figure 2:
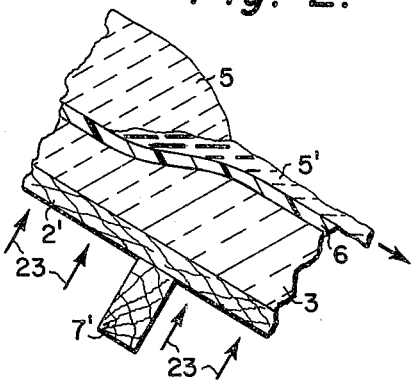
FIG. 2 is a partially cut away perspective view of another embodiment.

Another embodiment is shown in FIGS. 2 and 3 in which the lower base layer or first layer 2′ of the roof is plywood or other sheet material and a snow load 5 rests upon a part of the roof, compressing insulating layer 3. This layer consists of a resilient insulating mat, preferably a glass fiber mat containing fibers and air. The air provides the thermally insulating quality, permeating the glass fibers.

Frame members, such as member 7′, may support sheet material 2 in relatively rigid fixed position to other parts of building 20, which may be provided with furnace 21 (having smoke pipe 22) to heat the air in its interior to a temperature higher than the melting temperature of snow. Heat from furnace 21 may pass to the roof structure through layer 2′ as indicated by arrows 23 to melt snow 5, providing run-off water 5′.

When the roof structure was loaded, it compressed as follows:

| Load, lb./ft.² | % Compression (and approx. % reduction of thermal conductivity) |
|---|---|
| 0 | 0 |
| 0.1 | 11 |
| 0.5 | 24 |
| 1 | 46 |
| 2 | 58 |
| 3 | 64 |
| 5 | 69 |
| 10 | 78 |
| 15 | 83 |
| 20 | 85 |
| 25 | 86 |
| 30 | 86.4 |
| 50 | 90 |

Figure 4:
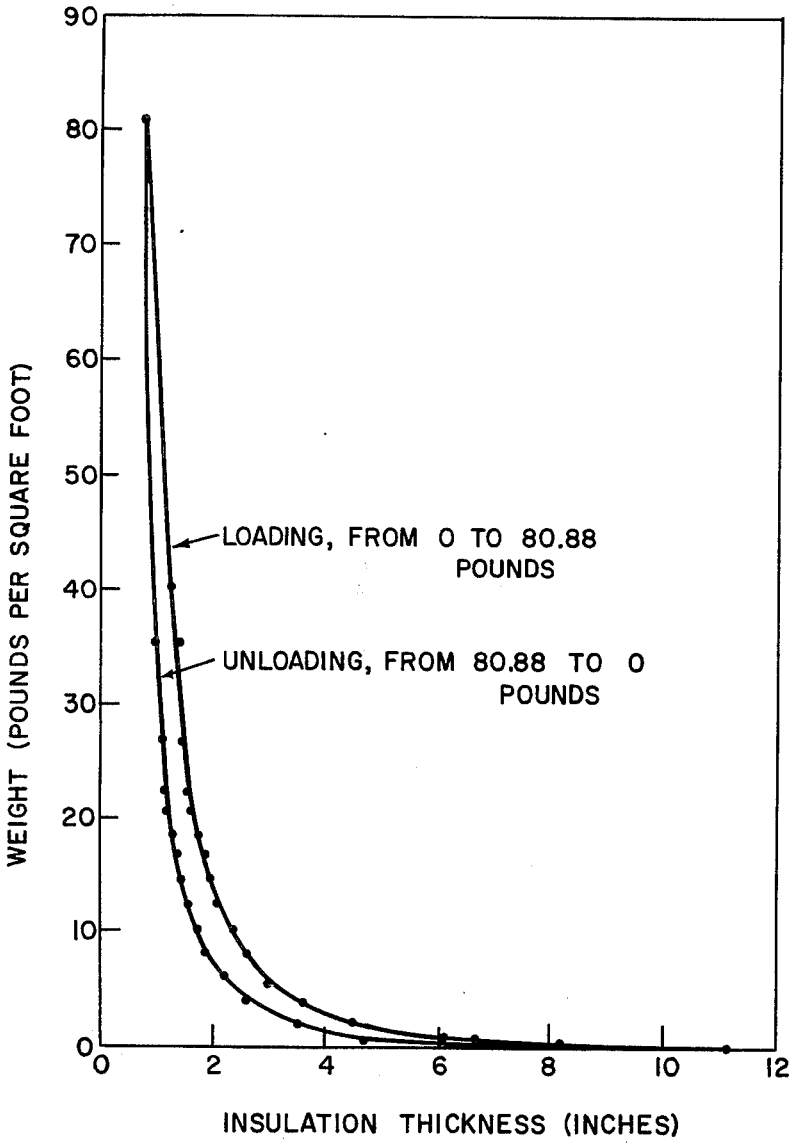
FIG. 4 is a graphical representation.

FIG. 4 is a graphical representation of the relationship between load applied to the insulation and the thickness of the insulated layer. The insulation tested was Johns-Manville "Spinsulation" fiberglass insulation, arranged in three layers of 3⅞ inches (nominal thickness). All samples were 12 inches square. Of course, different load-deflection curves may be obtained with other insulating materials, and by alteration of geometry.

Upon removal of the load the roof resumed nearly its original thickness, with a slight compression as shown by FIG. 4; upon successive loadings no more loss of thickness occurred.

Since the thermal conductivity is determined by the thickness of the air layer, it follows that the change of thermal conductance of the roof structures of the above examples will be reversibly reduced by superimposed snow loads to an extent inversely related to the weight loads shown in FIG. 4.

Thus, referring to FIG. 4, the thermal insulation at, for example, 30 lbs./ft.², the minimum design snow load required for school roofs in Wisconsin will be reduced to 13.6% of the original, and will substantially return to the original when the snow has melted. This reduction will lead to rapid snow removal, particularly on a roof slanting 5° or more, so that the snow load glides off as soon as the base is melted.

It is not material to the invention whether or not the inner supporting side of the room 2 is completely rigid, so long as it presents a considerable degree of immovability in relation to the outer film 6 or is considerably less yielding to pressure than the outer film, so that a pressure applied to said outer film 6 results in compression of the air-containing insulating layer 3. When this condition is met, we view the said inner or lower boundary film of the roof as substantially stationary. This applies whether said stationary quality is attained by the inherent properties of said film, or by the way it is mounted, tensed or backed.

Preferably we employ a degree of resilience and compressibility of the said insulating layer, in which it is compressed less than about 30% by light snow loads, such as ½ lb./ft.², so as not to lose heat unnecessarily, and more than 60% on a loading of 30 lbs./ft.², so as to rapidly melt or mobilize snow loads which approach the critical design limits customary in snow prone areas. At snow loads of 20 lbs./ft.² the thermal conductivity should be preferably at least doubled, yet return substantially to the original value as soon as the snow has melted or slid off the roof.

As the said resilient thermally insulating layer, we may use resilient mats other than glass, such as for example asbestos, particularly when resiliently bonded for example by means of an elastomeric adhesive such as a rubber cement; or a porous plastic foam (the pores preferably being open) of any resilient polymer, such as rubbers, polyesters, polyurethanes, cellulose and its esters and ethers, polypropylene or other resilient polyolefin resins, polystyrenes and their copolymers, polyphenoxy plastics, polyacrylonitril copolymers with acrylates, methacrylate and olefins such as butadiene, and any other plastic or polymer of similar mechanical properties that exists or that may come into being at any future time.

As the boundary film we prefer to employ a flexible foldable plastic film of any plastic material suitable for production of packaging film, such as for example a polyolefin, including polyethylenes, polypropylenes and their co-polymers, acrylates, metahcrylates, allylcarbonates, polyphenoxy films, polyvinyl halides, including the fluoride, fluoro olefins, cellulose esters and ethers, regenerated cellulose, polyvinylidene halides, polystyrene and its olefin and other co-polymers such as ABS polyester films, and films of any other plastic not yet invented having mechanical properties in the range of the above. We prefer to employ reinforced films, preferably where the fibers can slide to co-act in bundles at points of tear and incipient failure. Non-reinforced fibers can also be used but this is less desirable as the added strength of reinforcement results in a better and more desirable structure.

Having thus disclosed our invention, we claim:

1. In a building, means to dispose of snow loads which comprises the combination of:

a roof structure,
  said roof structure extending over a space containing air,
heating means,
  said heating means disposed to heat the air in said space to a temperature higher than the melting temperature of snow,
said roof structure characterized by comprising the combination of:
a first layer of sheet material,
  said first layer of sheet material being characterized by being flexible and foldable and comprising synthetic resin,
  substantially relatively rigid means to support said first layer in relatively substantially fixed position from other portions of the building,
an insulating layer of flexible elastically deformable compressible distensible material characterized by being permeated with air,
  said insulating layer overlying said first layer and being supported by said first layer,
a second layer of sheet material,
  said second layer of sheet material being flexible and foldable and comprising synthetic resin,
  said second layer overlying said insulating layer and being supported by said insulating layer,
said layers being in heatable relationship to said space so that heat from said air in said space passes to said first layer and thence to said insulating layer and thence to said second layer,
said structure further characterized by elastic deformability characteristics and heat transfer characteristics of said insulating layer and said second layer such that when the following snow loads are imposed on said second layer the distance from said first layer to said second layer is reduced respectively by the following percentage reductions to the following respective resulting distances expressed in percentage of the distance between said layers in the absence of any such load:

| Snow load in pounds per square foot | Percentage reduction | Distance |
|---|---|---|
| 0.5 | less than 30 | more than 70 |
| 20 | more than 50 | less than 50 |
| 30 | more than 60 | less than 40. |

* * * * *